US008459166B2

(12) United States Patent
Herrmann et al.

(10) Patent No.: US 8,459,166 B2
(45) Date of Patent: Jun. 11, 2013

(54) OBTURATION OF DRUM CANNONS

(75) Inventors: Ralf Joachim Herrmann, Königs Wusterhausen (DE); Hans Hülsewis, Duisburg (DE); Heiner Schmees, Celle (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 8 days.

(21) Appl. No.: 12/594,562

(22) PCT Filed: Mar. 20, 2008

(86) PCT No.: PCT/EP2008/002255

§ 371 (c)(1), (2), (4) Date: Mar. 31, 2010

(87) PCT Pub. No.: WO2008/119476

PCT Pub. Date: Oct. 9, 2008

(65) Prior Publication Data

US 2010/0175549 A1 Jul. 15, 2010

(30) Foreign Application Priority Data

Apr. 2, 2007 (DE) ..... 10 2007 016 204

(51) Int. Cl.
*F41A 3/76* (2006.01)

(52) U.S. Cl.
USPC ..... 89/26; 89/155

(58) Field of Classification Search
USPC ..... 89/155, 26
See application file for complete search history.

(56) References Cited

U.S. PATENT DOCUMENTS

| | | | | |
|---|---|---|---|---|
| 2,981,023 | A | 4/1961 | Sergay | |
| 3,354,780 | A * | 11/1967 | Ramsay | 89/26 |
| 3,783,737 | A * | 1/1974 | Ashley | 89/7 |
| 3,996,837 | A * | 12/1976 | Ashley et al. | 89/26 |
| 4,561,340 | A | 12/1985 | Bertiller et al. | |
| 5,535,660 | A * | 7/1996 | Zierler | 89/26 |
| 7,171,886 | B2 * | 2/2007 | Herrmann et al. | 89/26 |
| 2004/0007873 | A1 | 1/2004 | Herrmann et al. | |
| 2007/0028756 | A1 * | 2/2007 | Konicke | 89/26 |

FOREIGN PATENT DOCUMENTS

| | | | |
|---|---|---|---|
| DE | 15 78 101 | B1 | 4/1975 |
| DE | 23 61 074 | A1 | 10/1975 |
| DE | 20 15 140 | A1 | 8/1976 |

(Continued)

OTHER PUBLICATIONS

International Search Report, issued in corresponding application PCT/EP2008/002255, completed Jul. 24, 2008, mailed Aug. 1, 2008.

*Primary Examiner* — Michael Carone
*Assistant Examiner* — Reginald Tillman, Jr.
(74) *Attorney, Agent, or Firm* — Griffin & Szipl, P.C.

(57) ABSTRACT

A seal is proposed between the drum (2) having a plurality of cartridge chambers (3) and a weapon barrel (1) of a drum cannon, wherein the seal comprises at least one elastically pretensioned obturation ring (4). Each cartridge chamber (3) has an obturation ring (4) for drum-side integration, while one obturation ring (4) suffices for barrel-side integration. The obturation is integrated between the two and is pressed against the face (9) of the weapon barrel (1) or the face of the cartridge chamber (3) that is aligned with the bore axis of the weapon barrel (1) such that immediate sealing occurs even at low gas pressures.

11 Claims, 4 Drawing Sheets

FOREIGN PATENT DOCUMENTS

| | | | |
|---|---|---|---|
| DE | 24 60 391 | A1 | 10/1976 |
| DE | 32 37 728 | C2 | 2/1985 |
| DE | 295 18 928 | U1 | 4/1996 |
| DE | 102 13 928 | A1 | 10/2003 |
| EP | 1 719 966 | A1 | 11/2006 |
| EP | 1 757 892 | A1 | 2/2007 |
| GB | 2 287 779 | A | 9/1995 |

* cited by examiner

OBTURATION OF DRUM CANNONS

This is a National Phase Application in the United States of International Patent Application No. PCT/EP2008/002255 filed Mar. 20, 2008, which claims priority on German Patent Application No. DE 10 2007 016 204.0, filed Apr. 2, 2007. The entire disclosures of the above patent applications are hereby incorporated by reference.

FIELD OF THE INVENTION

The present invention pertains to a drum cannon that includes a seal between a drum provided with several chambers and a barrel of the cannon, characterized in that an elastically pre-tensioned obturation ring is integrated between the two, wherein the ring presses against the face of the barrel or the face of the chamber that is in line with the barrel bore axis of the barrel in such a way that sealing takes place immediately even with small gas pressures.

BACKGROUND OF THE INVENTION

A drum cannon comprises essentially a barrel and a drum containing several chambers. The drum is pivoted around an axis parallel to the barrel bore axis. The cartridge is pushed into the chamber, which is not in line with the barrel bore axis. Conventional bottleneck cartridges are pushed into the chamber in the aiming direction, whereas telescopic cartridges are introduced into the chamber against the aiming direction. The drum is rotated or moved until the cartridge and barrel bore axis are in line (DE 32 37 728 C2). For its part, the drum supports itself on a plate. This causes obturation problems thereby between the drum and the barrel.

These obturation problems were counteracted up to now by seal bushings between the drum and the barrel. For sealing, the seal bushing of each chamber was supported on the drum, wherein the seal bushings are moved slightly in the aiming direction. With bottleneck cartridges, the inner diameter of the seal bushing is somewhat larger than the land diameter of the barrel. During the shot, gas is guided against the face of the seal bushing in the aiming direction by means of a gas duct. Even before the seal bushing is acted upon by the gas pressure in the radial direction, the dynamic pressure pushes the opposing face of the seal bushing against the face of the barrel. This ensures a seal during the further course of the shot.

It is disadvantageous that sealing, by means of a bushing, is frequently insufficient. In particular with telescopic cartridges with combustible cases, there is the problem of guiding the gas jet onto the face of the seal bushing at the right time, before the seal bushing is impacted by gas pressure in the radial direction.

The object of the invention is to provide a seal between the drum and the barrel that seals more effectively than, for example, a bushing or the like.

SUMMARY OF THE INVENTION

The object stated above is achieved by means of a first embodiment of the present invention, which pertains to a seal disposed between drum (2), which is provided with several chambers (3), and a barrel (1), characterized in that an elastically pre-tensioned obturation ring (4) is integrated between the two, wherein the ring presses against the face (9) of the barrel (1) or the face of the chamber (3) that is in line with the barrel bore axis of the barrel (1) in such a way that sealing takes place immediately even with small gas pressures.

Advantageous additional embodiments are listed below. For example, in accordance with a second embodiment of the present invention, the first embodiment is modified so that the obturation ring (4) is pre-tensioned so far that it is not damaged during the rotating or moving of the drum (2). In accordance with a third embodiment of the invention, the first embodiment or the second embodiment is further modified so that the obturation ring 4 preferably has an L-shaped profile, wherein the angle between the arms (5, 6) is somewhat greater than 90° when the obturation ring (4) is not pre-tensioned. In accordance with a fifth embodiment of the present invention, the second embodiment is further modified so that the pre-tensioning takes place by means of a disk (8). In accordance with a sixth embodiment of the present invention, a drum cannon is provided that includes a drum provided with several chambers and a barrel, wherein a seal according to either the first, second, third, fourth or fifth embodiments of the invention, is disposed between the drum and the barrel.

The invention is based on the concept of integrating the seal so that it seals even before gas pressure occurs. This takes place by means of an elastically pre-tensioned seal between the drum and the barrel. If the seal is integrated on the drum side, each chamber has a seal. With integration on the weapon side, one seal on the barrel is sufficient.

An obturation principle is utilized that has become established with large-caliber barrel weapons with sliding wedge breechblocks and caseless propellant.

For sealing a mortar tube, it is suggested in DE 102 13 928 to embody the sealing element integrated between the barrel and floor piece as an L-shape.

It is preferred for the profile of the sealing ring between the drum and the barrel to be likewise L-shaped, wherein the angle between the arms is somewhat greater than 90°. This feature causes the lips to bear under pre-tensioning and sealing takes place immediately, even with lower gas pressures. The intensification of the sealing action through the gas pressure also ensures a complete sealing over the entire pressure area. Enlargement of the gap between the drum and the face of the barrel caused by the gas pressure is effected just as is the radial expansion of the chamber as a result of the gas pressure.

BRIEF DESCRIPTION OF THE DRAWINGS

The invention will be explained in more detail based on an exemplary embodiment with drawing. The drawings show.

DETAILED DESCRIPTION OF THE INVENTION

Figure 1:
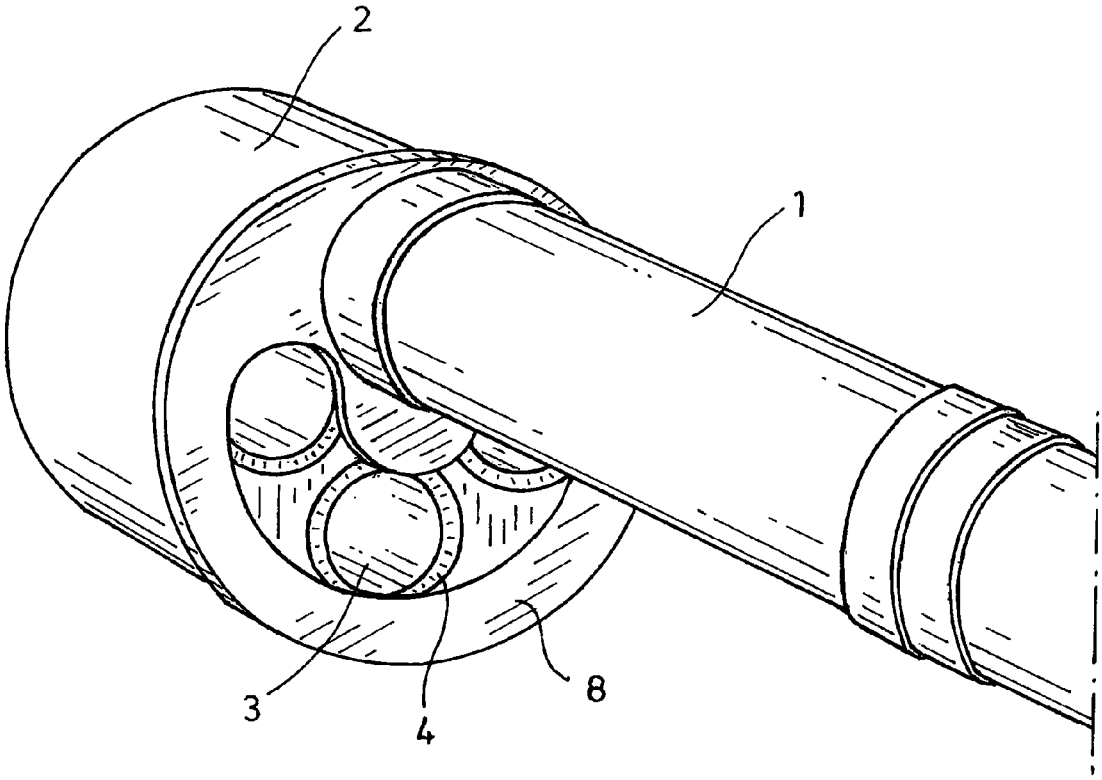
FIG. 1 a perspective representation of a drum cannon.
Figure 2:
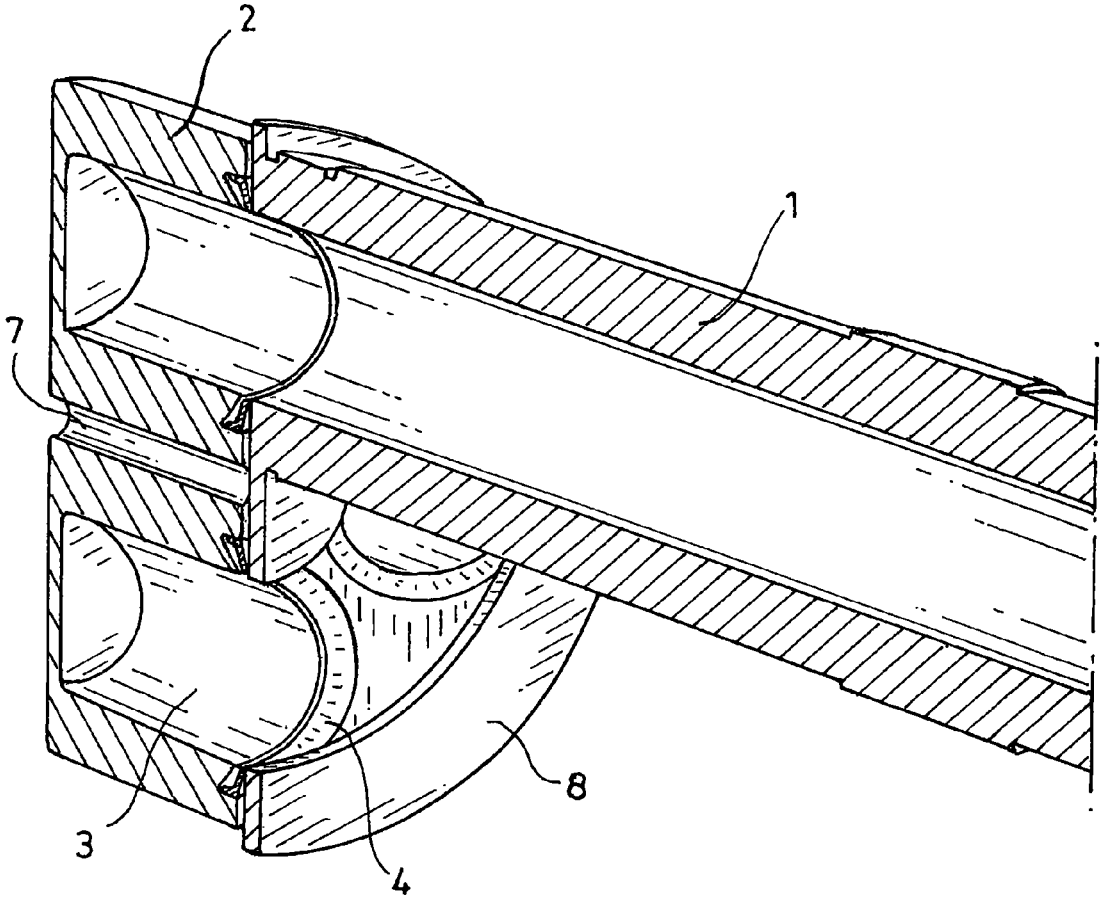
FIG. 2 a perspective representation of the drum cannon from FIG. 1 in sectional view.
Figure 3:
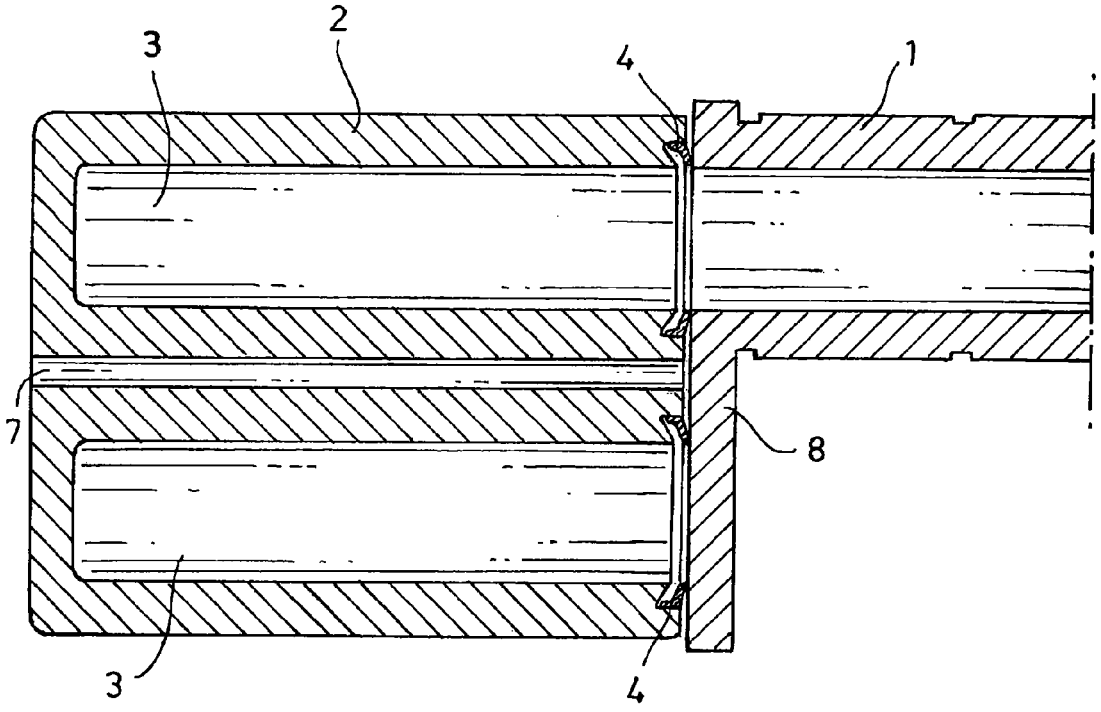
FIG. 3 a section through the drum cannon.
Figure 4:
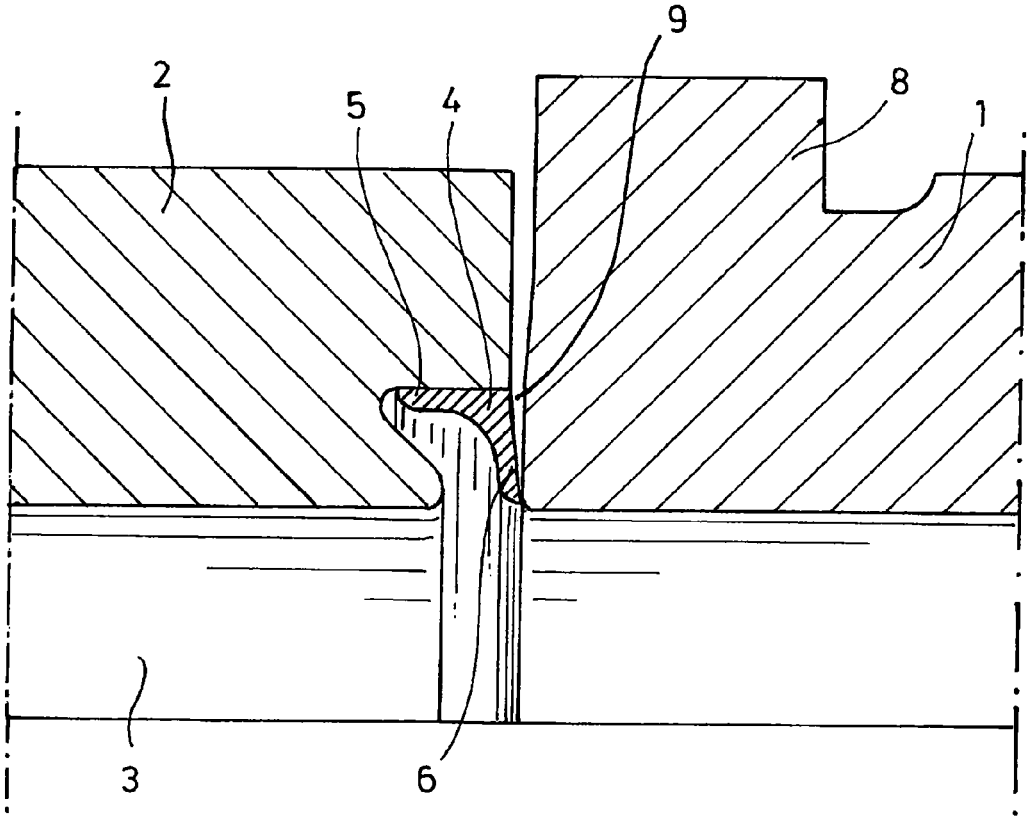
FIG. 4 a detailed representation of the obturation in section.

FIGS. 1 through 4 show a drum cannon including a barrel 1 with a drum 2, wherein the drum has several cylindrical chambers 3 for receiving, for example, telescopic cartridges (not shown in more detail), but also bottleneck cartridges. In each chamber 3, an obturation ring 4 is arranged that preferably has an L-shaped profile (e.g., includes arms 5,6), wherein the angle between the arms 5 and 6 is somewhat greater than 90° when the obturation ring 4 is not pre-tensioned (See FIG. 4).

Alternatively, an obturation ring of this type can be supported in the barrel (not shown in more detail).

The drum 2 is pivoted around an axis 7 to the barrel bore axis, or the drum can be moved to this position. The obturation rings 4 can be pre-tensioned by means of a disk 8 so they are not damaged during rotation or moving of the drum 2 (alternatively on the barrel 1). For the sake of clarity, the support of the drum 2 in the direction of the barrel bore axis is not shown in more detail, but is assumed to be known (i.e., a conventional support is employed).

In operation, cartridge is pushed into one of the chambers 3 (with a telescopic cartridge against the aiming direction), which is a chamber that is not in line with the barrel bore axis. Then the drum 2 is moved until the chamber containing the cartridge and barrel bore axis are in line. In this position, the arms 5 and 6 of the obturation ring 4, which is likewise in line, are pre-tensioned and press against the face 9 of the barrel 1 in such a way that sealing takes place immediately even with low gas pressures. Owing to the preferred geometry of the obturation ring 4, the gas pressure strengthens the sealing effect of the obturation ring 4 during operation of the drum cannon.

The invention claimed is:

1. A drum cannon comprising:

(a) a drum provided with several chambers, wherein the drum is pivotable around an axis;

(b) a barrel; and (c) an elastically pre-tensioned seal provided between the drum and the barrel, wherein the seal comprises a plurality of elastically pre-tensioned obturation rings integrated between the drum chambers and the barrel, wherein when the obturation rings are disposed to press against a face of the barrel or a face of the chamber that is in line with a barrel bore axis of the barrel, wherein each obturation ring has an L-shaped profile, and each obturation ring has arms, and each arm has a lip at an end, and wherein an angle between the arms is greater than 90° when the obturation ring is not pre-tensioned, and when the obturation ring is pre-tensioned, the lip at the end of one arm presses against the face of the barrel so that the seal provides sealing immediately between the drum and the barrel even with low gas pressures.

2. A drum cannon according to claim 1, wherein the plurality of obturation rings are pre-tensioned to a degree so that the rings are not damaged during rotation or moving of the drum.

3. A drum cannon according to claim 2, wherein a disk is disposed to pre-tension the plurality of obturation rings.

4. A drum cannon according to claim 1, wherein the seal employs gas pressure to strengthen the complete sealing over an entire pressure area.

5. A drum cannon according to claim 2, wherein the seal employs gas pressure to strengthen the complete sealing over an entire pressure area.

6. A drum cannon according to claim 1, wherein the lips of the arms bear under pre-tensioning to effect immediate sealing.

7. A drum cannon according to claim 2, wherein the lips of the arms bear under pre-tensioning to effect immediate sealing.

8. A drum cannon according to claim 1, wherein when the obturation ring is pre-tensioned, only the lip at the end of one arm presses against the face of the barrel so that the seal provides sealing immediately between the drum and the barrel even with low gas pressures.

9. A drum cannon according to claim 1, wherein the lip at the end of the one arm pressing against the face of the barrel is tapered and points diagonally with respect to a barrel bore axis of the barrel.

10. A drum cannon comprising:

(a) a drum provided with several chambers, wherein the drum is pivotable around an axis;

(b) a barrel; and (c) an elastically pre-tensioned seal provided between the drum and the barrel, wherein the seal comprises a plurality of elastically pre-tensioned obturation rings integrated between the drum chambers and the barrel, wherein the obturation rings are disposed to press against a face of the barrel or a face of the chamber that is in line with a barrel bore axis of the barrel, wherein the plurality of obturation rings are pre-tensioned by a disk so that the obturation rings are not damaged during rotation or moving of the drum, wherein each obturation ring has an L-shaped profile, and each obturation ring has arms, and each arm has a lip, and wherein an angle between the arms is greater than 90° when the obturation ring is not pre-tensioned, causing the lip of each arm to bear under pre-tensioning so that the seal provides sealing immediately between the drum and the barrel even with small gas pressures, and when the obturation rings are pre-tensioned, only the lip at an end of one arm of each obturation ring presses against the face of the barrel.

11. A drum cannon according to claim 10, wherein the lip at the end of the one arm pressing against the face of the barrel is tapered and points diagonally with respect to the barrel bore axis of the barrel.

* * * * *